US012458107B2

(12) United States Patent
Chancellor

(10) Patent No.: US 12,458,107 B2
(45) Date of Patent: Nov. 4, 2025

(54) SHOE PROTECTOR DEVICE AND APPLICATOR

(71) Applicant: Trainer Armour Limited, Marlbrook (GB)

(72) Inventor: Andrew Chancellor, Marlbrook (GB)

(73) Assignee: Trainer Armour Limited, Bromgrove (GB)

( * ) Notice: Subject to any disclaimer, the term of this patent is extended or adjusted under 35 U.S.C. 154(b) by 4 days.

(21) Appl. No.: 18/563,424

(22) PCT Filed: May 6, 2022

(86) PCT No.: PCT/EP2022/062253

§ 371 (c)(1),
(2) Date: Nov. 22, 2023

(87) PCT Pub. No.: WO2022/248190

PCT Pub. Date: Dec. 1, 2022

(65) Prior Publication Data

US 2024/0268520 A1 Aug. 15, 2024

(30) Foreign Application Priority Data

May 27, 2021 (GB) ..... 2107528

(51) Int. Cl.
*A43B 17/18* (2006.01)
*A43B 23/08* (2006.01)

(52) U.S. Cl.
CPC ..... *A43B 17/18* (2013.01); *A43B 23/086* (2013.01)

(58) Field of Classification Search
CPC ..... A43B 17/18; A43B 23/28
See application file for complete search history.

(56) References Cited

U.S. PATENT DOCUMENTS 2,584,516 A 2/1952 Veatch
2,865,097 A * 12/1958 Vollrath, Jr. ..... A43B 17/18 36/43
4,316,333 A * 2/1982 Rothschild ..... A43B 17/18 36/91
6,120,473 A * 9/2000 Oliverio ..... A61F 5/14 602/41

(Continued)

FOREIGN PATENT DOCUMENTS

GB 2 536 792 9/2016
WO WO 2022/248190 12/2022

OTHER PUBLICATIONS

GB Search Report Application No. GB2107528.8, dated Mar. 15, 2022.

(Continued)

*Primary Examiner* — Megan E Lynch
(74) *Attorney, Agent, or Firm* — Neil D. Gershon

(57) ABSTRACT

A shoe protector device for a trainer for the prevention of toe holes. The applicator consists of two display cards 2L and 2R each having the sole area 6 of a left foot and right foot respectively printed thereon. Additionally, a toe protector patch 12 with liner 8, is secured to a top end of the sole area of each card 2L and 2R in a position that would be occupied by a toe, such as a big toe. A low-tack semi-permanent adhesive secures the patch to the applicator so as to allow the patch to disengage from the applicator when a pulling force is applied.

15 Claims, 2 Drawing Sheets

(56) References Cited

U.S. PATENT DOCUMENTS

| | | | | |
|---|---|---|---|---|
| 6,205,685 | B1 * | 3/2001 | Kellerman | A43D 999/00 36/44 |
| 7,568,299 | B2 * | 8/2009 | Denha | A43B 23/086 36/71 |
| 8,490,300 | B1 | 7/2013 | Houston, III | |
| 9,949,531 | B2 | 4/2018 | Timco et al. | |
| 2005/0039349 | A1 * | 2/2005 | Grisoni | A43B 3/0057 36/180 |
| 2006/0026865 | A1 | 2/2006 | Grisoni et al. | |
| 2009/0300944 | A1 | 12/2009 | Miller | |
| 2011/0038904 | A1 * | 2/2011 | Matteliano | A61K 9/0014 424/401 |
| 2011/0232129 | A1 * | 9/2011 | Roberts | A43B 19/00 36/43 |
| 2011/0283562 | A1 * | 11/2011 | Shrum | B32B 25/10 427/289 |
| 2014/0109438 | A1 * | 4/2014 | Hoogerbrugge | A43B 13/40 36/43 |
| 2014/0338221 | A1 * | 11/2014 | Pride | A43B 7/145 36/44 |
| 2016/0157555 | A1 | 6/2016 | Timco et al. | |
| 2018/0116338 | A1 * | 5/2018 | Glaze | A43B 7/142 |
| 2022/0007781 | A1 * | 1/2022 | Baird | A43B 7/149 |

OTHER PUBLICATIONS

GB Search Report Application No. GB2107528.8, dated Jul. 17, 2023.

GB Search Report Application No. GB2107528.8, dated Nov. 6, 2023.

International Search Report Application No. PCT/EP2022/062253, mailing date Aug. 1, 2022.

Observation by a third party European Application No. 22728369.4, dated Sep. 18, 2023.

* cited by examiner

SHOE PROTECTOR DEVICE AND APPLICATOR

This application is a 371 of international application no. PCT/EP2022/062253, filed May 6, 2022, which claims the benefit of GB Application No. 2107528.8, filed May 27, 2021. The entire contents of each of these applications are incorporated herein by reference.

FIELD OF THE INVENTION

The present invention relates generally to a footwear protector device and an applicator therefor, particularly but not exclusively to protect against damage to training shoes.

BACKGROUND

Shoes, in particular trainers or other types of shoe that are made from a thin fabric, become worn during use which often leads to big toe holes appearing in the surface of the shoe. Such damage is becoming more prevalent due to trainers being provided in more lightweight thin materials, such as mesh fabrics, to minimize their weight. This damage to the shoe can often occur quite quickly, particularly in the case of fabric trainers that are used for running or other high impact sports. Frequently, these holes are the only damage in the shoe which would otherwise have a considerable length of wear time left in them. It is clearly undesirable to have to purchase a new expensive pair of shoes due to this minimal cosmetic damage in the upper surface of the shoe.

Attempts have been made to endeavour to overcome this problem. For example, U.S. Pat. No. 9,949,531 B2 (Shoe Armour LLC) describes a shoe hole prevention insert that consists of a sole pad that is placed on the inner sole of the shoe and has a toe guard and sidewall guard that extend from the sole pad and may be movable to a position within the shoe to protect the toe and side areas from wear. However, this shoe hole prevention insert is difficult to correctly install in the shoe, requiring the removal of the existing shoe sole, which on the majority of footwear is non-removable, to hold the sole pad in position and manoeuvring the guards into the correct position.

It is an object of the present invention to provide a footwear protector device with an accompanying applicator therefor that overcomes, or at least alleviates, the above-mentioned problems.

SUMMARY OF THE INVENTION

According to a first aspect of the present invention there is provided an applicator with a protective footwear device, the applicator comprising at least one template providing at least a partial shape of a sole of a foot and a footwear protector device comprising a patch temporarily adhered to a surface of the template in a region of the sole, at least part of an outer surface of the patch having a double-sided adhesive with a detachable liner attached to the outer adhesive surface.

The template may be of a whole foot or of a partial foot. Preferably, the applicator is in the form of a card having a template of a partial foot printed thereon. Preferably, a pair of templates are provided on separate applicators, one for a right foot and one for a left foot, each template having a patch temporarily adhered to a surface thereof, more preferably being in a big toe region of the sole. However, the patch may be provided at an alternative region, for example, in an area corresponding to the position of the smallest toe or a side of the sole of the foot.

The cards may be any suitable shape but preferably are rectangular cards and preferably the applicator provides for different shoe sizes, for example having templates for multiple shoe sizes imprinted thereon, preferably wherein the end user may cut around the template that is the appropriate shoe size.

Each patch is preferably an ovoid-shape. Preferably, the patch is made from a wear-resistant material, more preferably being made from an abrasion resistant material. Preferably, the material of the patch is also waterproof. One suitable material for the patch comprises a high-density polyurethane coated waterproof nylon fabric.

A temporary adhesive is preferably used to apply an inner surface of the patch to the applicator, such as a low-tack semi-permanent adhesive, such as a removable pressure sensitive adhesive with low peel strength and medium shear strength as in known in the art, the low tack semi-permanent adhesive being configured to allow the patch to disengage from the applicator when a pulling force is applied.

A double-sided adhesive tape is preferably applied to an outer surface of the patch with the other side of the tape including a removable liner, preferably being comprised of a siliconized release film. The adhesive is preferably a tackified acrylic adhesive. A tab preferably extends from one edge of the liner to aid removal of the liner from the surface of the patch.

Applicators according to the invention may be provided with different patches of colours, size and/or shape.

A second aspect of the present invention provides a kits of parts for protecting footwear, such as a trainer, the kit comprising at least a pair of applicators according to the first aspect of the present invention.

The kit of parts preferably includes a set of printed instructions packaged with the parts. Replacement patches of different size, shape and/or colour may also be provided in the kit.

A third aspect of the present invention provides a method of protecting footwear, such as a fabric shoe or trainer from being worn thin through wear, the method comprising:

- cutting around the template of an applicator with a protective footwear device according to the first aspect of the present invention;
- removing the detachable liner from the patch;
- placing the cut template with uncovered patch into the footwear to be protected;
- applying pressure to an outer surface of the footwear in the region in which the patch is to be applied; and
- removing the template from the footwear to leave the protective patch adhered to the footwear.

BRIEF DESCRIPTION OF THE DRAWINGS

For a better understanding of the present invention and to show more clearly how it may be carried into effect, reference will now be made by way of example only to the accompanying drawings in which.

DETAILED DESCRIPTION

The present invention provides an applicator with a footwear protector device that prevents holes appearing in thinner fabric shoes, particularly trainers, due to pressure from the wearer's big toe. The condition that causes big toe holes to appear is called hyperextension of the distal phalanx. This means that every time a person with this condition takes a step, their big toe lifts and rubs against the inside of their shoe. If the shoe is made of a thick material, such as leather, the shoe is able to withstand this pressure but for shoes made of thinner materials, such as trainers, this rubbing from the inside leads to a hole appearing. It is becoming the norm for all trainers to be made from a thin, breathable mesh material as this provides enhanced comfort for the wearer, but this results in big toe holes readily appearing while the rest of the trainer appears almost new.

It is desirable to be able to extend the lifespan of fabric shoes, particularly expensive trainers. The present invention addresses this need by providing a shoe protector device with applicator which enables a protective patch or pad to be secured to the shoe quickly and easily in a position which protects the area of the shoe that is subjected to repetitive rubbing from a wearer's big toe.

Figure 1A:
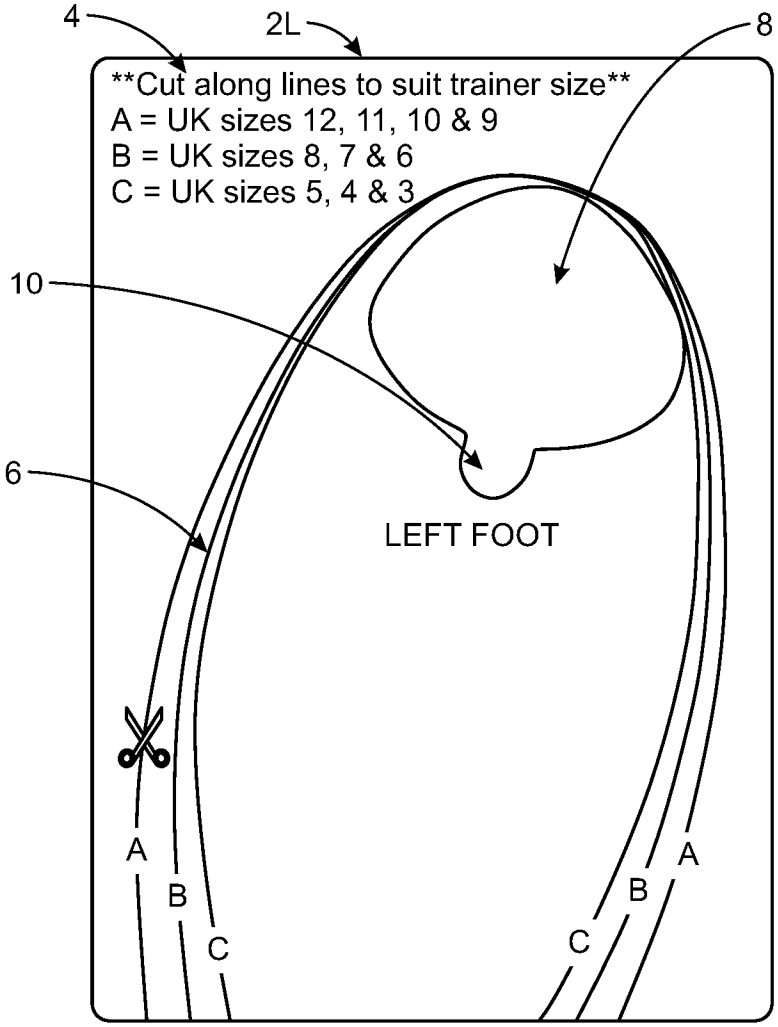
FIGS. 1A and 1B are respectively a left foot and right foot applicator with shoe protector device according to one embodiment of the present invention.
Figure 1B:
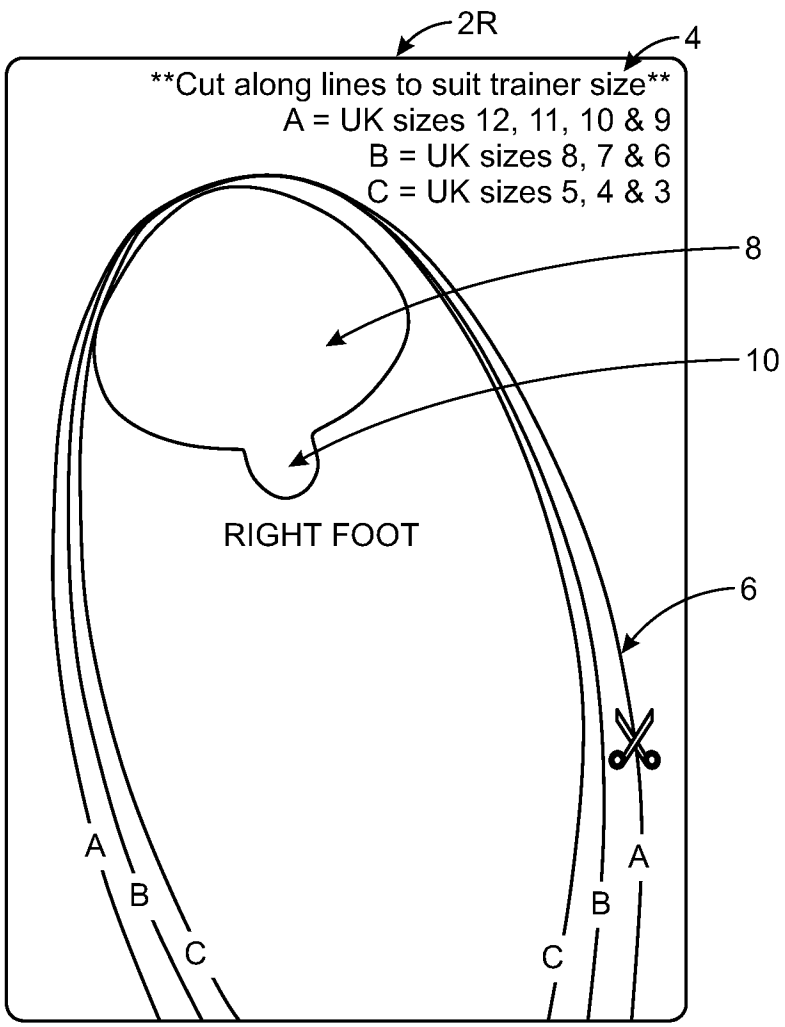

A preferred embodiment of the present invention is shown in FIGS. 1A and 1B of the accompanying drawings. The applicator consists of two display cards 2L and 2R each having the sole area 6 of a left foot and right foot respectively printed thereon. Additionally, a big toe protector patch 12 (see FIG. 2) with liner 8, for example comprising a siliconized release film, is secured to a top end of the sole area of each card 2L and 2R in a position that would be occupied by a big toe. The liner 8, and the patch 12 below, are in the general shape of an ovoid, albeit other shapes may be used, such as circular.

The patch is made of a wear-resistant, preferably abrasion-resistant and waterproof material, such as a high performance, high density polyurethane coated waterproof nylon fabric, for example N9171 6 oz PU coated nylon fabric supplied by Henderson Textiles. It is secured to an applicator card 2 by an adhesive. The adhesive that secures the patch to the applicator is a low-tack semi-permanent adhesive, such as a removable pressure sensitive adhesive with low peel strength and medium shear strength. This type of adhesive allows the patch to disengage from the applicator when a pulling force (removing the applicator from the footwear) is applied.

A double-sided adhesive tape, such as tackified acrylic adhesive, such as a that known as Tesa® 4962 manufactured and sold by TESA is fastened to the upper surface of the patch and the liner 8 remains on this adhesive until its application to a shoe. Each liner is also provided with a tab 10 extending from a lower end thereof.

The applicator card is provided with additional information 4 ("Cut along lines to suit trainer size") to aid installation of the patch. The printed sole area is provided in multiple sizes A, B, C which correspond to different sizes of foot (for example, A corresponding to UK sizes 12-9; B corresponding to UK sizes 8-6 and C corresponding to UK sizes 5 to 3). A pair of applicator cards 2L and 2R are packaged with a set of instructions detailing how to apply the patches correctly to a shoe.

Figure 2:
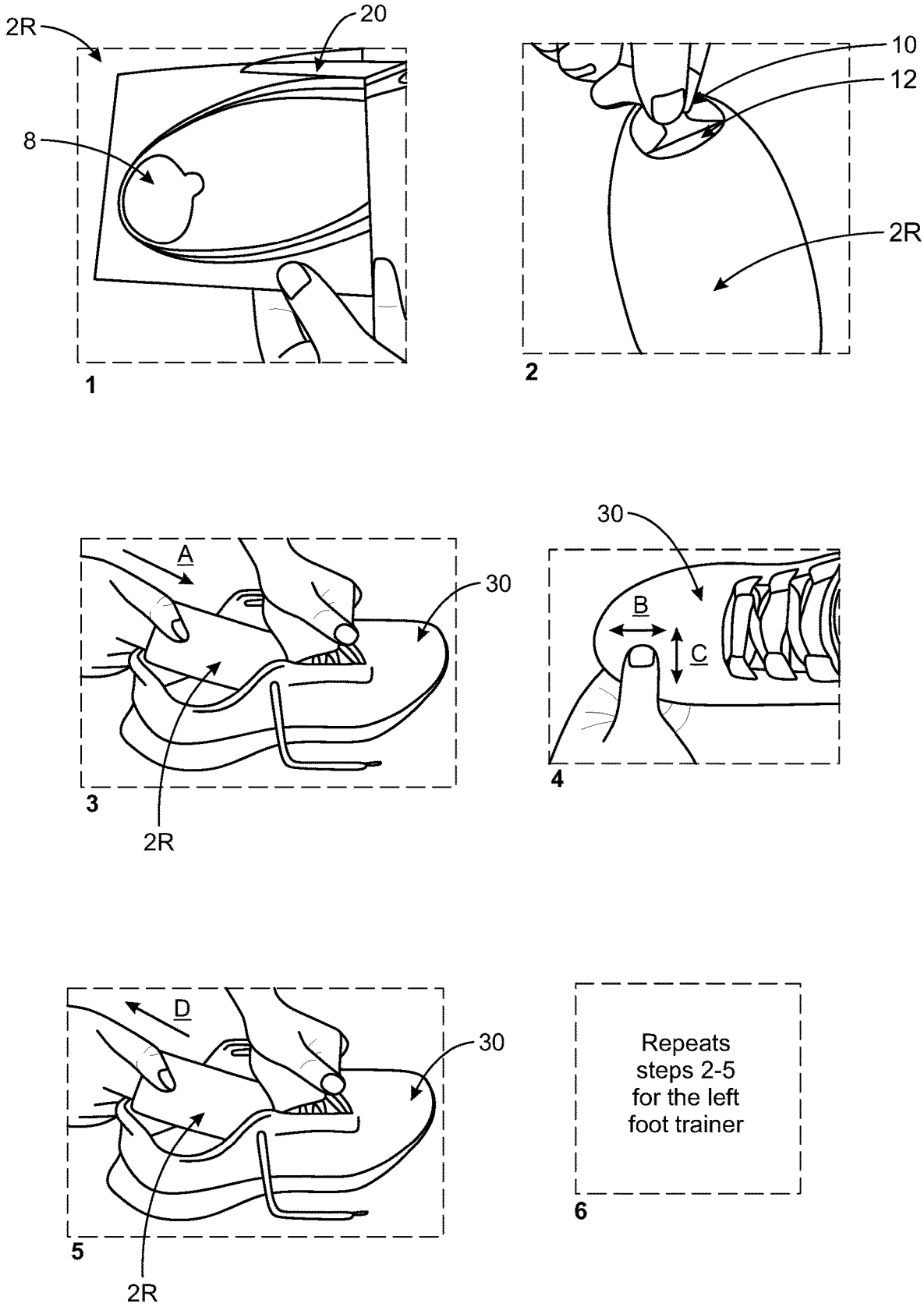
FIG. 2 illustrates a series of steps for applying the shoe protector device with the applicator shown in FIGS. 1A and 1B.

FIG. 2 of the accompanying figures illustrates the steps involved in use of the applicator to correctly apply a patch 12 to a trainer 30. Initially, one of the applicator cards for the right or left trainer is removed from the package along with a set of user instructions and the user cuts along a line A, B or C using scissors 20 according to their trainer size (see step 1). Once the sole area has been cut from the card 2R, the tab 12 is pulled upwardly to remove the liner 8 from the patch 12. The liner may be discarded. The card 2R with uncovered patch 12 is then placed within the trainer 30, pushing the card in the direction of arrow A shown in step 3 of FIG. 2 to the end of the trainer so that it is flat against the insole. Once in position, the user's thumb is used to push down on the surface of the trainer in the region of the patch, moving in different directions as shown by arrows B and C in step 4. This results in the sticky upper surface of the patch 12 becoming securely attached to the inner fabric surface of the trainer in the region where the big toe is positioned. Ideally, a little time is spent rubbing over the location of the patch to aid adhesion to the trainer 30. It is then possible to remove the applicator card 2R from the shoe as shown by arrow D in step 5. The patch remains secured to the trainer 30 and the card may be recycled. Once the applicator is removed, it is preferable to reach inside the trainer and press against the patch to ensure proper adherence to the trainer. The steps are then repeated to secure a similar patch 12 to the left hand trainer using card 2L.

The patches guard against wear from the big toe which is generally the first part of the trainer to experience damage. In this manner, the lifespan of the trainers is substantially increased. The applicator ensures quick and easy placement of the patches in the correct region of the trainer.

The illustrated example demonstrates attachment of a shoe protector device to a trainer for the prevention of big toe holes. However, it is to be appreciated that the protective patch may be applied to any type of footwear. Moreover, the patch may be located elsewhere on the applicator card, for example corresponding to the position of a different toe to the big toe or an area of the sole of the foot. Thus, the template may be adapted to apply the protective patch to a different region of the footwear as appropriate.

The protective patches may be provided in different colours to match a particular colour of trainer fabric. Multiple patches may also be provided within a package, for example to allow a single pair of applicators to be used for applying more than one set of patches and/or to allow different colour patches to be provided for selection by the user. Although the applicator cards are shown to be adjustable in size, an alternative embodiment provides the sole area already cut to size.

The present invention allows for easy application of a protective shoe patch. Both the applicator and patch may be manufactured relatively cheaply enabling an individual to reinforce expensive shoes, particularly trainers, prior to them being worn thereby enabling the shoes to last longer. The invention may also be used to repair already damaged shoes, particularly if the patch is provided in the same colour as the fabric of the shoe.

Further modifications to the applicator and protective shoe device may be made without departing from the principles embodied in the examples described and illustrated herein.

The invention claimed is:

1. A removable applicator for applying a protective patch to footwear, the applicator comprising at least one card and the protective patch, the at least one card having an upper surface and a lower surface and providing a template of at least a partial shape of a sole of a foot, the applicator being configured to apply the protective patch to footwear prior to removal of the card without the patch from the footwear, the protective patch being temporarily adhered to the upper surface of the card in a region of the sole, the card having a low-tack semi-permanent first adhesive to temporarily adhere an inner surface of the patch to the upper surface of the card, the low tack semi-permanent first adhesive being configured to allow the patch to disengage from the card when a pulling force is applied and wherein at least part of an outer surface of the patch is provided with a second adhesive, said second adhesive being a double-sided adhesive having one side attached to the patch and the other side provided with a detachable liner, both the first and second adhesives facing upwardly from the upper surface of the card of the applicator.

2. The applicator as claimed in claim 1, wherein the template is of a whole foot or of a partial foot.

3. The applicator as claimed in claim 2, wherein the card provides the template by printing the shape of at least a partial foot thereon.

4. The applicator as claimed in claim 1, wherein a pair of templates are provided on separate applicators, one for a right foot and one for a left foot, each template having a patch temporarily adhered to a surface thereof.

5. The applicator as claimed in claim 1 wherein the patch is adhered to the surface of the template in a toe region of the sole.

6. The applicator as claimed in claim 1 wherein the applicator has multiple shoe sizes imprinted thereon, the applicator being configured to be cut to the template that is an appropriate shoe size.

7. The applicator as claimed in claim 1, wherein the patch is made from at least one of a wear-resistant material and an abrasion resistant material.

8. The applicator as claimed in 7 wherein the patch comprises a high-density polyurethane coated waterproof nylon fabric.

9. The applicator as claimed in claim 1, wherein the double-sided second adhesive is double sided adhesive tape applied to an outer surface of the patch with the other side of the tape including the detachable liner.

10. The applicator as claimed in claim 9, wherein the second adhesive is a tackified acrylic adhesive.

11. The applicator as claimed in claim 1, wherein the detachable liner is comprised of a siliconized release film.

12. The applicator as claimed in claim 1, wherein at least one tab extends from one edge of the detachable liner to aid removal of the detachable liner from the surface of the patch.

13. A kit of parts for protecting footwear, such as a trainer, the kit comprising at least a pair of applicators according to claim 1.

14. The kit of parts as claimed in claim 13, further comprising a set of printed instructions packaged with the parts.

15. The kit of parts as claimed in claim 13, further comprising replacement patches of any size, shape and/or colour provided in the kit.

* * * * *